US005378567A

United States Patent [19]

Nozomi et al.

[11] Patent Number: 5,378,567

[45] Date of Patent: Jan. 3, 1995

[54] POLYCARBONATE BINDER RESIN AND ELECTROPHOTOGRAPHIC PHOTOCONDUCTOR CONTAINING THE SAME

[75] Inventors: Mamoru Nozomi; Akiko Miyake; Michio Kawai, all of Yokohama, Japan

[73] Assignee: Mitsubishi Kasei Corporation, Tokyo, Japan

[21] Appl. No.: 47,433

[22] Filed: Apr. 15, 1993

[30] Foreign Application Priority Data

Apr. 16, 1992 [JP] Japan ..... 4-096822
Feb. 9, 1993 [JP] Japan ..... 5-021478

[51] Int. Cl.[6] ..... G03G 5/04
[52] U.S. Cl. ..... 430/58; 430/96
[58] Field of Search ..... 430/58, 56, 96

[56] References Cited

U.S. PATENT DOCUMENTS 5,080,987 1/1992 Odell et al. ..... 430/96
5,080,989 1/1992 Gruenbaum et al. ..... 430/96

FOREIGN PATENT DOCUMENTS 0356246 2/1990 European Pat. Off. .
0538795 4/1993 European Pat. Off. .

*Primary Examiner*—John Goodrow
*Attorney, Agent, or Firm*—Oblon, Spivak, McClelland, Maier & Neustadt

[57] ABSTRACT

Disclosed herein is an electrophotographic photoconductor comprising:

a conductive substrate;

a charge-generation layer formed on said conductive substrate; and a charge-transport layer formed on said charge-generation layer, said charge-transport layer comprising a charge-transport material and a binder resin which comprises a polycarbonate composed of at least one specified structural unit derived from benzophenone or a derivative thereof and at least one another specified structural unit derived from diphenylmethan or a derivative thereof.

10 Claims, 1 Drawing Sheet

POLYCARBONATE BINDER RESIN AND ELECTROPHOTOGRAPHIC PHOTOCONDUCTOR CONTAINING THE SAME

BACKGROUND OF THE INVENTION

The present invention relates to an electrophotographic photoconductor. More particularly, it relates to an electrophotographic photoconductor having an excellent durability in which a particular binder resin is used.

Electrophotography, because of its instantaneity and capability of forming high-quality images, has been widely used and applied in recent years not only in the field of duplication but also in the field of various types of printing. Regarding the photoconductor in the art of electrophotography, there have been widely used inorganic photoconductive materials such as selenium, arsenic-selenium alloy, cadminum sulfide, zinc oxide, etc., as main component material of the photoconductor, and more recently, there have been used organic photoconductive materials having advantages in pollution-free and good film-forming properties and easy production. As the organic photoconductors, there are known the so-called dispersion-type photoconductors in which photoconductive fine particles are dispersed in a binder resin, and the laminate-type photoconductors in which a charge-generation layer and a charge-transport layer are laminated.

In view of the facts that a photoconductor of high sensitivity can be obtained by combining a high-efficiency charge-generation material and a high-efficiency charge-transport material, that the laminate-type photoconductor has a wide scope of choice for component materials and is high in safety in use, and that these are also high in coating productivity and relatively low in cost, it is considered that probability is high for the laminate-type photoconductors to dominate the market, and studies are being made for the development and practical use of this type of photoconductor.

However, the currently available laminate-type photoconductors are inferior in durability to the inorganic type. The photoconductor are poor in physical property which is one of factors that determine durability, that is, they have the disadvantage that the photoconductor are susceptible to abrasion and surface scratches due to various loads applied in use, such as development with toner, friction with paper and abrasion by the cleaning members in which the load thereof varies depending on the method, so that the printing durability of the photoconductors is limited in practical use.

Generally, in the case of laminate-type photoconductor, these loads are applied to the charge-transport layer. The charge-transport layer is usually composed of a binder resin and a charge-transport material. Although the strength of the layer is substantially decided by the binder resin, the layer is not provided with a satisfactory mechanical strength due to the high doping amount of the charge-transport material.

As the binder resin for the charge-transport material, there have been used various types of thermoplastic and thermosetting resins such as polymethyl methacrylate, polystyrene, vinyl polymers such as polyvinyl chloride, copolymers thereof, polycarbonates, polyesters, polysulfones, phenoxy resins, epoxy resins, silicone resins, etc. Among the available binder resins, polycarbonates have comparatively excellent properties, and various types of polycarbonates have been developed and put to practical use. For example, Japanese Patent Application Laid-Open (Kokai) No. 50-98332 (1975) discloses bisphenol P-type polycarbonates, and Japanese Patent Application Laid-Open (Kokai) No. 59-71057 (1984) discloses bisphenol Z-type polycarbonates. Also, Japanese Patent Application Laid-Open (Kokai) No. 60-184251 (1985) proposes use of copolymer-type polycarbonates of bisphenol P and bisphenol A as a binder resin.

Further, Japanese Patent Application Publication (Kokoku) No. 48-38430 (1973) discloses the heterogeneous photoconductive compositions (disperse layer) comprising an organic pigment and a polymer, and teaches that these heterogeneous photoconductive compositions can be produced with good reproducibility by using various types of polycarbonates as the polymer. But there is nothing about the mechanical properties such as wear resistance of these compositions.

However, when a laminate-type photoconductor made by using such heterogeneous photoconductive composition is used in a high-speed electrophotographic process, in most cases it is unsatisfactory in abrasion and scratch resistances. Thus, the development of a binder resin having higher qualities has been desired.

As a result of the present inventors' extensive studies on binder resin used for the photosensitive layer, it has been found that in an electrophotograpahic photoconductor having at least a charge-generation layer and a charge-transport layer on a conductive substrate, by using as a binder resin a particular polycarbonate composed of at least one structural unit represented by the formula I described later and at least one structural unit represented by the formula II described later, the obtained electrophotographic photoconductor shows well satisfactory mechanical and electrical properties with excellent stability.

SUMMARY OF THE INVENTION

An object of the present invention is to provide an electrophotographic photoconductor which is very slight in variation of sensitivity and charging property, is excellent in mechanical properties, is minimized in abrasion of the layer by the cleaning blades, etc., and is highly resistant to surface scratches which may affect the copied images, hence very excellent in durability.

Another object of the present invention is to provide an electrophotographic photoconductor having very excellent responsiveness and applicable to high-speed electrophotographic processes.

Still another object of the present invention is to provide an electrophotographic photoconductor which is substantially free from occurrence of fault in coating of the layer and can be produced by a process with extremely high productivity.

To achieve these objects, in an aspect of the present invention, there is provided an electrophotographic photoconductor comprising:

a conductive substrate;

a charge-generation layer formed on the conductive substrate; and a charge-transport layer formed on the charge-generation layer, the charge-transport layer comprising a charge-transport material and a binder resin which comprises a polycarbonate composed of at least one structural unit represented by the following formula I:

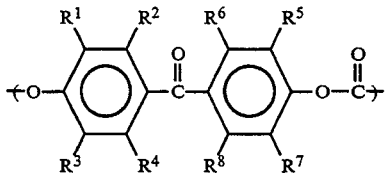

(I)

wherein $R^1$, $R^2$, $R^3$, $R^4$, $R^5$, $R^6$, $R^7$ and $R^8$ each represent independently a hydrogen atom, a saturated or unsaturated aliphatic hydrocarbon group having 1 to 6 carbon atoms, a halogen atom or a phenyl group; and at least one structural unit represented by the following formula II:

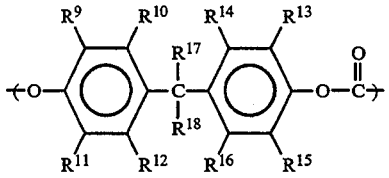

(II)

wherein $R^9$, $R^{10}$, $R^{11}$, $R^{12}$, $R^{13}$, $R^{14}$, $R^{15}$ and $R^{16}$ each represent independently a m hydrogen atom, a saturated or unsaturated aliphatic hydrocarbon group having 1 to 6 carbon atoms, a halogen atom or a phenyl group, and $R^{17}$ and $R^{18}$ each represent independently a hydrogen atom, an alkyl group having 1 to 6 carbon atoms or a phenyl group, or $R^{17}$ and $R^{18}$ are combined to form a saturated or unsaturated aliphatic hydrocarbon ring or an aliphatic hydrocarbon ring having an aromatic ring.

DETAILED DESCRIPTION OF THE INVENTION

Figure 1:
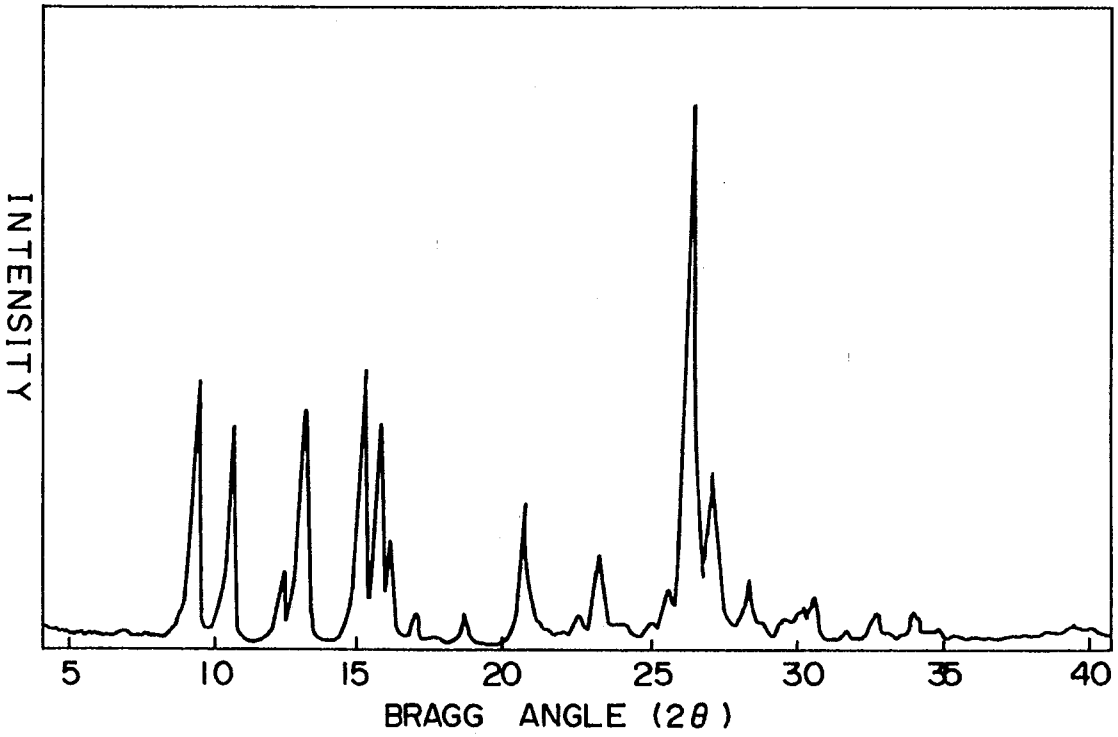
FIG. 1 is a powder X-ray spectrum of titanyl phthalocyanine used in Example 8, which was obtained by an X-ray powder method.

As the conductive substrate, there can be mentioned one formed from a metallic material such as aluminum, stainless steel, copper, nickel or the like, or one made of a polyester film, a phenol resin pipe, a paper pipe or the like on which a conductive layer composed of aluminum, copper, palladium, tin oxide, indium oxide or the like is formed.

A charge-generation layer is formed on the photoconductive substrate. If necessary, a barrier layer such as commonly used may be interposed therebeween. As the barrier layer, a film composed of polyamide, polyurethane, cellulose, nitrocellulose, sodium caseinate, polyvinyl alcohol, polyvinyl pyrrolidone, polyacrylamide, aluminum anodic oxide and the like can be used. The thickness of the barrier layer is usually 0.1 to 20 μm.

The charge-generation materials usable for forming the charge-generation layer include selenium and alloys thereof, cadminum sulfide, other inorganic photoconductive materials, and organic pigments such as phthalocyanine pigment, azo pigment, quinacridone pigment, indigo pigment, perylene pigment, polycyclic quinone pigment, anthanthrone pigment, benzimidazole pigment and the like. The fine particles of such material are used together with a binder resin such as polycarbonate, polyvinyl acetate, polyacrylic ester, polymethacrylic ester, polyester, polyvinyl acetoacetal, polyvinyl propional, polyvinyl butyral, phenoxy resin, epoxy resin,. urethane resin, cellulose ester, cellulose ether and the like to form a charge-generation layer.

The charge-generation material such as mentioned above is blended in a amount of 30 to 500 parts by weight, preferably 30 to 300 parts by weight, based on 100 parts by weight of the binder resin. The thickness of the charge-generation layer is usually 0.1 to 1 μm, preferably 0.15 to 0.6 μm.

The material is usable for forming the charge-transport layer include electron-attracting substances such as 2,4,7-trinitrofluorenone, tetracyanoquinodimethane, etc.; heterocyclic compounds such as carbazole, indole, imidazole, oxazole, pyrazole, oxadiazole, pyrazoline, thiadiazole, etc.; aniline derivatives; hydrazone compounds; aromatic amine derivatives; stilbene derivatives; and polymers having in the main or side chain a group derived from the above-mentioned compounds. The particles of such charge-transport material are used together with a binder resin comprising at least the polycarbonate according to the present invention which is composed of at least one structural units represented by the formula I and at least one structural units represented by the formula II to form the charge-transport layer.

The charge-transport material is used in an amount of 20 to 150 parts by weight, preferably 50 to 130 parts by weight, based on 100 parts by weight of binder resin. The thickness of the charge-transport layer is usually 5 to 50 μm, preferably 10 to 45 μm. An additive or additives such as plasticizer, antioxidant, ultraviolet absorber, leveling agent, etc. , may be contained in the charge-transport layer for improving the film-forming properties, plasticity, coating properties, etc.

The polycarbonate according to the present invention is composed of at least one structural unit represented by the formula I and at least one structural unit represented by the formula II. The content of the structural unit represented by the formula I is usually 3 to 80 mol %, preferably 5 to 50 mol %, more preferably 5 to 30 mol %, still more preferably 5 to 20 mol % based on the total structural units of the polycarbonate.

When the content of the structural unit of the formula I in the total structural units of the polycarbonate is too high, wear resistance tends to be high but solubility in a solvents tends to be lowered. In view of this, it is preferable to use the polycarbonate in which the content of the structural unit of the formula I is within the range of 5 to 30 mol %.

The viscosity-average molecular weight of the polycarbonate used in the present invention is usually in the range of 10,000 to 500,000, preferably 15,000 to 250,000, more preferably 15,000 to 150,000.

In the above formula I, $R^1$, $R^2$, $R^3$, $R^4$, $R^5$, $R^6$, $R^7$ and $R^8$ each represent independently a hydrogen atom, a saturated or unsaturated aliphatic hydrocarbon group having 1 to 6 carbon atoms such as methyl, ethyl, propyl, isopropyl, propenyl, allyl, isobutyl, pentyl, etc., a halogen atom such as a chlorine atom, a bromine atom and an iodine atom, or a phenyl group. Preferably, they each represent a hydrogen atom, a methyl group or a halogen atom.

In the above formula II, $R^9$, $R^{10}$, $R^{11}$, $R^{12}$, $R^{13}$, $R^{14}$, $R^{15}$ and $R^{16}$ each represent independently a hydrogen atom, a saturated or unsaturated hydrocarbon group having 1 to 6 carbon atoms such as methyl, ethyl, propyl, isopropyl, propenyl, allyl, isobutyl, pentyl, etc. , a halogen atom such as a chlorine atom, a bromine atom and an iodine atom, or a phenyl group. Preferably, they each represent a hydrogen atom, a methyl group or a halogen atom. The $R^{17}$ and $R^{18}$ each represent independently a hydrogen atom, a saturated or unsaturated hydrocarbon group having 1 to 6 carbon atoms such as methyl, ethyl, propyl, isopropyl, propenyl, allyl, isobutyl, pentyl, etc., or a phenyl group. Alternatively, $R^{17}$ and $R^{18}$ may be combined to form a saturated or unsaturated aliphatic hydrocarbon ring of cyclohexyl group, etc. , or an aliphatic hydrocarbon ring having an aromatic ring. The ring preferably has 5 to 12 carbon atoms, more preferably 5 or 6 carbon atoms. The $R^{17}$ and $R^{18}$ each preferably represent a hydrogen atom, a methyl group or an ethyl group.

A mixture of the polycarbonate according to the present invention and other binder resin may be used as binder resin in the present invention.

Examples of the other binder resin usable here include polycarbonates other than the polycarbonate according to the present invention, polyvinyl acetate, polyacrylic esters, polymethacrylic esters, polyesters, polyvinyl acetoacetal, polyvinyl propional, polyvinyl butyral, phenoxy resins, epoxy resins, urethane resins, cellulose esters, cellulose ethers and the like. The content of the polycarbonate according to the present invention in the binder resin is preferably not less than 50% by weight, more preferably not less than 70% by weight, for obtaining more satisfactory effect of the present invention.

The polycarbonate according to the present invention can be easily synthesized according to a conventional method by using at least one of the bisphenol compounds represented by the following formula A and at least one of the bisphenol compounds represented by the following formula B:

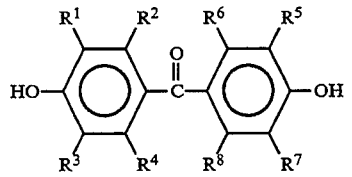

(A)

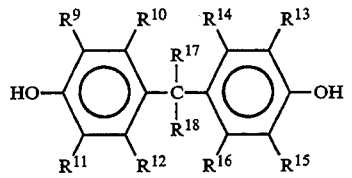

(B)

In the above formulae A and B, $R^1$ to $R^{18}$ represent the same substituents as $R^1$ to $R^{18}$ in the afore-shown formulae I and II.

Examples of the compound of the formula A include the following:

A-1: bis(4-hydroxyphenyl) ketone,
A-2: bis(3-methyl-4-hydroxyphenyl) ketone,
A-3: bis(3-phenyl-4-hydroxyphenyl) ketone,
A-4: bis(3-chloro-4-hydroxyphenyl) ketone,
A-5: bis(3,5-dimethyl-4-hydroxyphenyl) ketone,
A-6: bis(3-propyl-4-hydroxyphenyl) ketone,
A-7: bis(3-isopropyl-4-hydroxyphenyl) ketone, and
A-8: bis(3-allyl-4-hydroxyphenyl) ketone.

Examples of the compound of the formula B include the following:

B-1: bis( 4-hydroxyphenyl) methane,
B-2: 1, 1-bis(4-hydroxyphenyl)ethane,
B-3: 2,2-bis(4-hydroxyphenyl)propane,
B-4: 2,2-bis(4-hydroxyphenyl)butane,
B-5: 2, 2-bis(4-hydroxyphenyl)isobutane,
B-6: 2,2-bis(4-hydroxyphenyl) octane,
B-7: 1-phenyl-1, 1-bis(4-hydroxyphenyl)ethane,
B-8: 1,1-bis(4-hydroxyphenyl)-1-phenylmethane,
B-9: 1, 1-bis(4-hydropyphenyl)cyclopentane,
B-10: 1,1-bis( 4 -hydroxyphenyl )cyclohexane,
B-11: 2,2-bis(3-methyl-4-hydroxyphenyl)propane,
B-12: bis( 3-methyl-4-hydroxyphenyl)methane,
B-13: I, 1-bis(3-methyl-4-hydroxyphenyl) ethane,
B-14: 1, 1 -bis( 3-methyl-4-hydroxypheny 1 ) cyclohexane,
B-15: 2,2-bis( 3-chloro-4-hydroxyphenyl)propane,
B-16: bis( 3-chloro-4-hydroxyphenyl)methane,
B-17: 1,1-bis(3-chloro-4-hydroxyphenyl)ethane,
B-18: 1,1-bis( 3-chloro-4-hydroxyphenyl)cyclohexane,
B-19: 2,2-bis(3-isopropyl-4-hydroxyphenyl)propane,
B-20: bis(3- isopropyl -4-hydroxyphenyl)methane,
B-21: 1,1-bis(3- isopropyl-4-hydroxypheny 1 ) ethane,
B-22: 1,1-bis( 3 - isopropyl - 4 -hydroxyphenyl ) cyclohexane,
B-23: 2,2-bis(3,5-dimethyl-4-hydroxyphenyl) propane,
B-24: bis(3,5-dimethyl-4-hydroxyphenyl) methane,
B-25: 1,1-bis(3,5-dimethyl,-4-hydroxyphenyl)ethane,
B -26: 1,1-bis(3, 5-dimethyl-4 -hydroxyphenyl)cyclohexane,
B-27: 2,2-bis(3-allyl-4hydroxyphenyl)propane,
B-28: bis(3-allyl-4-hydroxyphenyl)methane,
B-29: 1, 1-bis(3-allyl-4-hydroxyphenyl)ethane,
B-30: 1, 1-bis(3-allyl-4-hydroxyphenyl)cyclohexane,
B-31: 2,2-bis(3-phenyl-4-hydroxyphenyl)propane,
B-32:bis(3-phenyl-4-hydroxyphenyl)methane,
B-33: 1,1-bis(3-phenyl-4-hydroxyphenyl)ethane,
B-34: 1, 1-bis( 3-phenyl-4-hydroxyphenyl)cyclohexane,
B-35: 1-phenyl-1,1-bis(3-methyl-4 -hydroxyphenyl)ethane,
B-36: 1 -phenyl- 1, 1-bis( 3-chloro-4 -hydroxypheny)ethane,
and
B-37: 1-phenyl- 1,1 -bis( 3-phenyl-4-hydroxyphenyl)ethane.

In Tables 1 and 2, examples of the polycarbonate according to the present invention are shown together with the starting materials and the molar ratio of the bisphenol compounds represented by the formulae A and B.

TABLE 1

| Polycarbonate No. | Compound of the formula A | Compound of the formula B | Molar ratio [compound of the formula A/compound of the formula B] |
|---|---|---|---|
| 1 | A-1 | B-2 | 10/90 |
| 2 | A-1 | B-2 | 30/70 |
| 3 | A-1 | B-2 | 50/50 |
| 4 | A-1 | B-11 | 10/90 |
| 5 | A-1 | B-11 | 15/85 |
| 6 | A-1 | B-11 | 30/70 |
| 7 | A-1 | B-11 | 45/55 |
| 8 | A-1 | B-7 | 25/75 |
| 9 | A-1 | B-7 | 50/50 |
| 10 | A-1 | B-10 | 10/90 |
| 11 | A-1 | B-10 | 25/75 |
| 12 | A-1 | B-10 | 50/50 |

TABLE 1-continued

| Polycarbonate No. | Compound of the formula A | Compound of the formula B | Molar ratio [compound of the formula A/compound of the formula B] |
|---|---|---|---|
| 13 | A-2 | B-2 | 25/75 |
| 14 | A-2 | B-11 | 25/75 |
| 15 | A-2 | B-7 | 25/75 |
| 16 | A-2 | B-10 | 25/75 |
| 17 | A-3 | B-2 | 25/75 |
| 18 | A-3 | B-11 | 25/75 |
| 19 | A-3 | B-7 | 25/75 |
| 20 | A-3 | B-10 | 25/75 |
| 21 | A-4 | B-3 | 25/75 |
| 22 | A-4 | B-11 | 25/75 |
| 23 | A-4 | B-7 | 25/75 |
| 24 | A-4 | B-10 | 25/75 |
| 25 | A-5 | B-3 | 25/75 |
| 26 | A-5 | B-11 | 25/75 |
| 27 | A-5 | B-7 | 25/75 |
| 28 | A-5 | B-10 | 25/75 |
| 29 | A-6 | B-3 | 25/75 |
| 30 | A-6 | B-11 | 25/75 |
| 31 | A-6 | B-7 | 25/75 |
| 32 | A-6 | B-10 | 25/75 |
| 33 | A-7 | B-3 | 25/75 |
| 34 | A-7 | B-11 | 25/75 |
| 35 | A-7 | B-7 | 25/75 |
| 36 | A-7 | B-10 | 25/75 |
| 37 | A-8 | B-3 | 25/75 |
| 38 | A-8 | B-11 | 25/75 |
| 39 | A-8 | B-7 | 25/75 |
| 40 | A-8 | B-10 | 25/75 |
| 41 | A-1 | B-3 | 60/40 |
| 42 | A-1 | B-3 | 75/25 |
| 43 | A-1 | B-11 | 60/40 |
| 44 | A-1 | B-11 | 75/25 |
| 45 | A-1 | B-7 | 75/25 |
| 46 | A-1 | B-10 | 70/30 |

TABLE 2

| Poly-carbonate resin | Compound of the formula A | Compounds of the formula B | Molar ratio [compound of the formula A/compound of the formula B] | Molar fraction of the compound shown on the left side of two compounds of the formula B (%) |
|---|---|---|---|---|
| 47 | A-1 | B-3/B-11 | 10/90 | 50 |
| 48 | A-1 | B-3/B-11 | 30/70 | 50 |
| 49 | A-1 | B-3/B-11 | 50/50 | 50 |
| 50 | A-1 | B-7/B-11 | 10/90 | 50 |
| 51 | A-1 | B-7/B-11 | 50/50 | 50 |
| 52 | A-1 | B-7/B-11 | 60/40 | 50 |
| 53 | A-1 | B-7/B-10 | 25/75 | 66.6 |
| 54 | A-1 | B-7/B-10 | 50/50 | 60 |
| 55 | A-1 | B-3/B-10 | 10/90 | 66.6 |
| 56 | A-1 | B-3/B-10 | 25/75 | 46.7 |
| 57 | A-1 | B-3/B-10 | 50/50 | 50 |

Among the polyarbonates listed in Tables 1 and 2, the polycarbonates of 5, 6, 10, 11, 14, 16, 21, 22, 24, 29, 31, 47, 48, 49, 50, 51, 52, 53, 55, 56 and 57 are preferred, and the polycarbonates of 5, 6, 10, 11, 14, 16, 47, 48, 50, 55 and 56 are more preferred.

The electrophotographic photoconductor of the present invention can be produced by dissolving a binder resin containing a polycarbonate composed of the structural units represented by the formulae I and II in an appropriate solvent together with a photoconductive material and/or a charge-transport material, adding if necessary a sensitizing dye, an electron donating compound, an electron attracting compound and/or other additive(s) such as plasticizer, antioxidant, ultraviolet absorber, leveling agent, etc., to prepare a coating solution, applying the resultant coating solution to a conductive substrate, and drying the same to form a photosensitive layer with a thickness of usually about 0.1 to 50 μm. The photosensitive layer composed of a charge-generation layer and a charge-transport layer can be formed by applying said coating solution containing the photoconductive material and/or the charge-transport material on the charge-generation layer formed on the conductive substrate and driving the same.

The solvents usable in preparing the coating solution include aromatic hydrocarbons such as benzene, toluene, xylene, etc.; ketones such as acetone, methyl ethyl ketone, diethyl ketone, methyl isobutyl ketone, cyclohexanone, cyclopentanone, etc.; esters such as methyl acetate, ethyl acetate, methyl propionate, methyl cellosolve, ethyl cellosolve, etc.; alcohols such as methanol, ethanol, propanol, butanol, etc.; ethers such as tetrahydrofuran, dioxane, dimethoxymethane, dimethoxyethane, diglyme, etc.; halogenated hydrocarbons such as carbon tetrachloride, chloroform, methylene chloride, dichloroethane, trichloroethylene, chlorobenzene, etc.; amides such as N,N-dimethylformamide, N,N-dimethylacetamide, etc.; dimethyl sulfoxide; 4-methoxy-4-methylpentanone-2, and the like. These solvents may be used either singly or in combination.

The electrophotographic photoconductor in which a polycarbonate according to the present invention is used, is very slight in variation of sensitivity and charging property, excellent in mechanical properties and minimized in abrasion of the layer by the cleaning blade and other elements, so that the photoconductor is highly resistant to surface scratches that may affect the copy images and hence high in durability. Also, the photoconductor has very good responsiveness in comparison with those made by using other binder polymers and is therefore applicable to the high-speed electrophotographic processes.

Further, the polycarbonate according to the present invention has good solubility in organic solvents and also shows high solubility even in non-halogen type solvents such as 1,4-dioxane, tetrahydrofuran, etc. Thus, since a coating solution can be prepared by using these solvents, the present invention is advantageous in safety and hygienic aspect.

Moreover, since the coating solution has a good stabilizing with the passage of time, the risk of faults being caused in the coating step in the manufacture of the electrophotographic photoconductor is markedly lessened, so that the productivity is greatly enhanced.

EXAMPLES

The present invention will hereinafter be described more particularly with reference to the preparation examples, examples and comparative examples. It is to be understood, however, that these examples are given for the purpose of illustration only, and are not to be construed as limiting the scope of the invention in any way. In the following descriptions of the examples, all "parts" and "%" are by weight unless otherwise noted.

PREPARATION EXAMPLE

(a) Preparation of polycarbonate oligomer

A mixture of 100 parts of 2,2-bis(3-methyl-4-hydroxyphenyl) propane, 50 parts of sodium hydroxide, 870 parts of water, 530 parts of methylene chloride and 2 parts of p-tert-butylphenol was supplied into a reactor equipped with a stirrer and stirred at 800 r.p.m. Then 70 parts of phosgene was blown through the mixture over a period of 2 hours to carry out interfacial polymerization. After the reaction, only the methylene chloride solution containing the polycarbonate oligomer was collected. The analytical results of the obtained methylene chloride solution of oligomer were as follows:

| | |
|---|---|
| Oligomer concentration (note 1) | 24.0 wt % |
| Terminal chloroformate group concentration (note 2) | 0.56 N |
| Terminal phenolic hydroxyl group concentration (note 3) | 0.13 N |

Notes:
1) Measured after evaporating the solution to dryness.
2) The aniline hydrochloride obtained by reacting the oligomer with aniline was subjected to neutralization titration with a 0.2 N sodium hydroxide solution.
3) The color developed when the oligomer was dissolved in a titanium tetrachloride and acetic acid solution was subjected to colorimetric determination at 546 nm.

The oligomer solution obtained in the manner described above is referred to as 'oligomer solution A. '

(b) Preparation of oligomer solution

An oligomer solution B was prepared by following the same process as the oligomer preparation (a) except for use of bis(4-hydroxyphenyl) ketone in place of 2,2-bis(3-methyl-4-hydroxyphenyl)propane. The obtained oligomer solution is referred to 'oligomer solution B.'

(c) Preparation of polycarbonate of No. 5 in Table 1

Two hundred and eighteen (218) parts (85 mol %) of oligomer solution A, 32 parts (15 mol %) of oligomer solution B, 150 parts of methylene chloride and 0.3 parts of p-tert-butylphenol were supplied into a reactor having a stirrer and the resultant mixture was stirred at 550 r.p.m. Then an aqueous solution composed of 14 parts of sodium hydroxide, 0.07 parts of triethylamine and 80 parts of water was further supplied into the reactor to carry out interfacial polymerization for 3 hours. Thereafter, from the reaction mixture, the methylene chloride solution containing the polycarbonate resin was separated and washed first with water, then with a hydrochloric acid solution and again with water, and finally methylene chloride was evaporated away to obtain a resin. The viscosity-average molecular weight of this resin was 31,200. The "viscosity-average molecular weight" referred to herein is the value determined from the following expressions (1) and (2) from $\eta_{SP}$ which was measured at 20° C. by using a 6.0 g/methylene chloride solution of polymer:

$$\eta_{SP}/C=[\eta](1+K'\cdot\eta_{SP}) \quad (1)$$

$$[\eta]=KM^{\alpha} \quad (2)$$

wherein
C: polymer concentration
$[\eta]$: intrinsic viscosity
$K'=0.28$
$K=1.23\times10^{-5}$
$\alpha=0.83$
M: viscosity-average molecular weight

EXAMPLE 1

Ten (10) parts of a bisazo compound having the structure shown below was added to 150 parts of 4-methoxy-4-methylpentanone, and the obtained mixture was ground and dispersed by a sand grinding mill. The resulting pigment dispersion was added to a mixture of 100 parts of a 5% dimethoxyethane solution of polyvinyl butyral (trade name: #6000-C, produced by Denki Kagaku Kogyo K.K.) and 100 parts of a 5% dimethoxyethane solution of phenoxy resin (trade name: PKHH, produced by Union Carbide Co. Ltd. ) to prepare a dispersion having a final solids concentration of 4.0%.

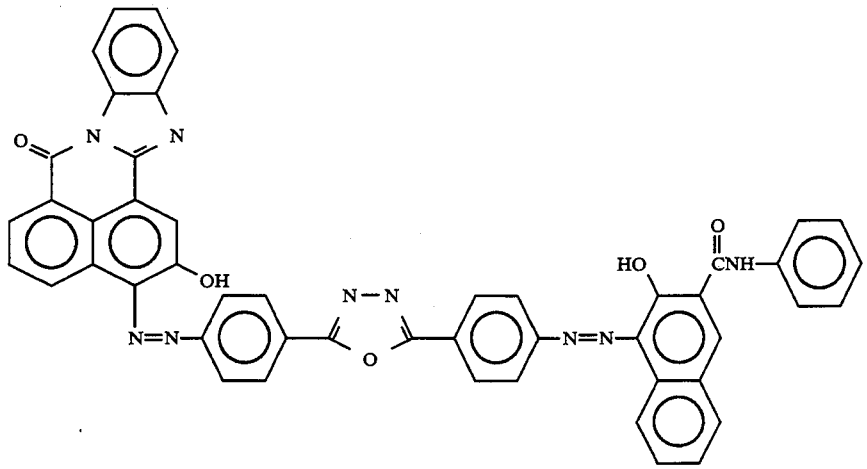

In the thus obtained dispersion, a planished aluminum cylinder having an outer diameter of 80 mm, a length of 340 mm and a wall thickness of 1.0 mm was dip-coated to form a charge-generation layer in an amount after drying of 0.45 g/m$^2$ (thickness after drying: 0.5 μm).

Then the aluminum cylinder was again dip-coated in a solution prepared by dissolving 95 parts of a hydrazone compound having the following structure:

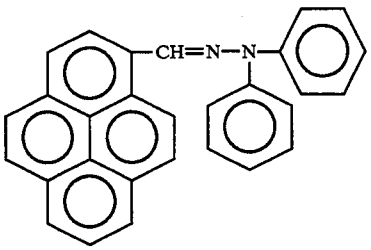

1.5 parts of a cyano compound having the following structure:

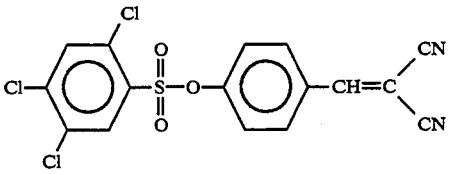

and 100 parts of the polycarbonate of No. 5 (in Table 1) having a viscosity-average molecular weight of 31,200 in a mixed solvent of dioxane and tetrahydrofuran, and then dried at 125° C. for 25 minutes to form a charge-transport layer 2having a thickness after drying of 20 μm.

The thus obtained electrophotographic photoconductor is referred to as 'photoconductor A.'

COMPARATIVE EXAMPLE 1

A photoconductor B was made by the same procedure as in Example 1 except that a polycarbonate (viscosity-average molecular weight: 32,800) of the following structural unit was used as a binder resin in forming the charge-transport layer.

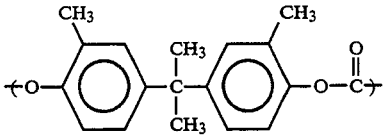

EXAMPLE 2

A photoconductor C was made by following the same procedure of Example 1 except that the polycarbonate of No. 3 (viscosity-average molecular weight: 34,000) was used as a binder resin in forming the charge-transport layer.

COMPARATIVE EXAMPLE 2

A photoconductor D was made by the same procedure as in Example 1 except that a polycarbonate of the following structural unit (viscosity-average molecular weight: 32,000) was used as a binder resin in forming the charge-transport layer.

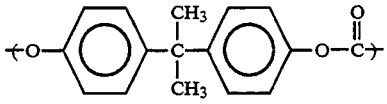

Each of these electrophotographic photoconductors was subjected to a 100,000-copy reproducing test by using a commercial copying machine (SF-8800, mfd. by Sharp Co., Ltd.). The results of measurements of variations of potential and thickness of the sensitive layer are shown in Table 3.

As seen from the results, the photoconductor A of the present invention showed very: high potential stability. Also, the evaluation of the copy images showed that when using the photoconductor A of the present invention, good image quality was maintained ::in all of the 100,000 copies, whereas in the case of the photoconductor B of the Comparative Example 1, the loss of the layer in the copying operation was great and the image density began to lower gradually as the number of the copies taken reached about 50,000. These results demonstrate to a remarkable improvement of mechanical strength (abrasion resistance) of the photoconductor A of the present invention. It is further noted that the photoconductor C of the present invention is also markedly improved in wear resistance as compared with the photoconductor D of the Comparative Example 2.

TABLE 3

| Photoconductor | Initial: Potential at unexposed area (V) | Initial: Potential at exposed area (V) | After 100,000 copies were taken: Potential at unexposed area (V) | After 100,000 copies were taken: Potential at exposed area (V) | Sensitive layer thickness (μm): Initial | Sensitive layer thickness (μm): After 100,000 copies were taken |
|---|---|---|---|---|---|---|
| A | −700 | −20 | −685 | −30 | 20 | 17.5 |
| B (Comparative example) | −700 | −20 | −625 | −15 | 20 | 15.5 |
| C | −700 | −15 | −670 | −20 | 20 | 16.0 |
| D (Comparative | −700 | −20 | −550 | −20 | 20 | 12.5 |

TABLE 3-continued

| Photo-conductor | Initial: Potential at unexposed area (V) | Initial: Potential at exposed area (V) | After 100,000 copies were taken: Potential at unexposed area (V) | After 100,000 copies were taken: Potential at exposed area (V) | Sensitive layer thickness (μm): Initial | Sensitive layer thickness (μm): After 100,000 copies were taken |
|---|---|---|---|---|---|---|
| example) | | | | | | |

EXAMPLE 3

A photoconductors E was made by the same procedure as in Example 1 except that a polycarbonate of Example 3 in Table 4 was used as a binder resin in forming the charge-transport layer, and that the coating was dried at room temperature for 30 minutes, then at 100° C. for 30 minutes and further at 125° C. for additional 30 minutes to form the charge-transport layer having a thickness after drying of 35 μm.

COMPARATIVE EXAMPLE 3

A photoconductor F was made by the same procedure as in Example 3 except four using of a polycarbonate of Comparative Example 3 in Table 4 as a binder resin in forming the charge-transport layer.

These photoconductors E and F were subjected to a 100,000-copy reproducing test by using a commercial copying machine (SHARP SF-9400). The abrasion loss of the layer in the test is shown in Table 5. The results show that the photoconductor E of the present invent ion is far superior to the photoconductor F of the Comparative Example 3 in wear resistance. Also, evaluating the image quality of the copies after the 100,000-copy reproducing test conducted by using the photoconductor E of the present invention, it was found that the copies had no problems at all regarding image density, image background and image faults.

EXAMPLES 4–7 and COMPARATIVE EXAMPLE 4

Each of the aluminum cylinders having a charge-generation layer formed in the same way as in Example 1 was dip-coated in the solutions prepared by dissolving 56 parts of N-methylcarbazole-9-carbaldehyde diphenylhydrazone, parts of 4,4 '-dimethoxybenzophenone diphenylhydrazone, parts of 3, 5-di-tert-butyl-4-hydroxytoluene, 1.5 parts of 4-(2,2-dicyanovinyl)benzene-2,4,5-trichlorobenzene sulfonate and 100 parts of each of the copolymerized polycarbonates shown in Table 4 in a mixed solvent of dioxane and tetrahydrofuran, and the coating was dried at 125° C. for 25 minutes to form a charge-transport layer having a thickness after drying of 20 μm, thereby obtaining each of the photoconductors shown in Table 4.

EXAMPLE 8 and COMPARATIVE EXAMPLE 5

Ten (10) parts of titanyl phthalocyanine having the powder X-ray spectral pattern shown in FIG. 1 was added to 140 parts of 1,2-dimethoxyethane, and the mixture was subjected to a grinding and dispersing treatment by a sand grinding mill. The resulting pigment dispersion was added to a mixture of 100 parts of a 5% dimethoxyethane solution of polyvinyl butyral (trade name: #6000-C produced by Denki Kagaku Kogyo K.K.) and 100 parts of a 5% dimethoxyethane solution of a phenoxy resin (trade name: PKHH, Union Carbide) to prepare a dispersion having a solids concentration of 4.0%.

in the thus prepared dispersion, the planished aluminum cylinders having an outer diameter of 80 mm, a length of 340 mm and a wall thickness of 1.0 mm were dip coated to form a charge-generation layer having a thickness after drying of 0.3 μm.

Then each aluminum cylinder was further dip-coated in the solution prepared by dissolving 60 parts of a hydrazone compound having the structure shown below, 1.5 parts of 4-(2,2-dicyanovinyl)benzene-4-nitrobenzoate and 100 parts of each of the copolymerized polycarbonates shown in Table 4 in a mixed solvent of dioxane and tetrahydrofuran, and dried at 125° C. for 25 minutes to form a charge-transport layer having a thickness after drying of 17 μm, thereby obtaining each of the photoconductors shown in Table 4.

TABLE 4

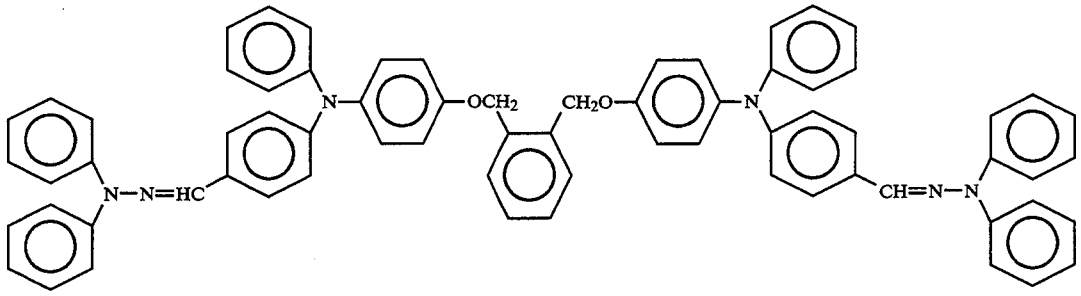

| | Photo-conductor | Copolymer polycarbonate compositions* | viscosity-average molecular weight |
|---|---|---|---|
| Example 3 | E | A-1/B-11/B-7 = 10/45/45 | 21,000 |

TABLE 4-continued

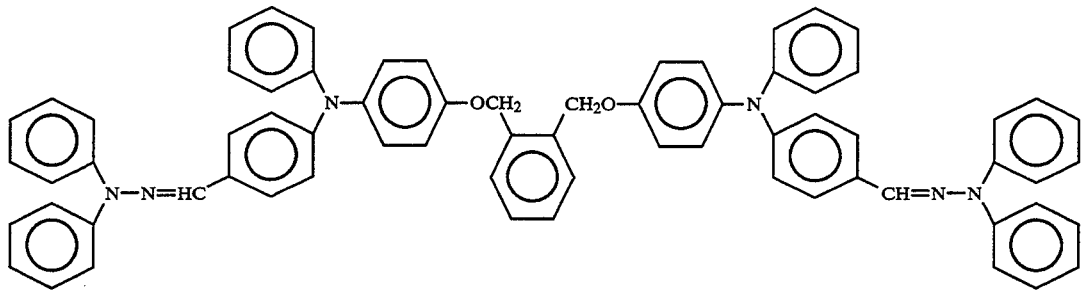

| | Photo-conductor | Copolymer polycarbonate compositions* | viscosity-average molecular weight |
|---|---|---|---|
| Comparative Example 3 | F | B-11/B-7 = 50/50 | 20,000 |
| Example 4 | G | A-1/B-11/B-7 = 4/48/48 | 33,700 |
| Example 5 | H | A-1/B-11/B-7 = 6/47/47 | 28,300 |
| Example 6 | I | A-1/B-11/B-7 = 18/41/41 | 32,600 |
| Example 7 | J | A-1/B-11/B-7 = 12/44/44 | 29,000 |
| Comparative Example 4 | K | B-11/B-7 = 50/50 | 30,000 |
| Example 8 | L | A-1/B-11/B-7 = 6/47/47 | 28,400 |
| Comparative Example 5 | M | B-11/B-7 = 50/50 | 30,000 |

*Shown by molar ratios of the bisphenol compounds of the formulae (A) and (B) which are the starting compounds.

These photoconductors E, F, G, G, I, J, K, L and M were subjected to a 100,000- copy reproducing test by using a commercial copying machine (SHARP SF-8800), and the abrasion loss of the sensitive layer of each of said photoconductors in the test was measured. The results are shown in Table 5.

TABLE 5

| | Photoconductor | Abrasion loss |
|---|---|---|
| Example 3 | E | 3.2 μm |
| Comparative Example 3 | F | 4.2 μm |
| Example 4 | G | 3.1 μm |
| Example 5 | H | 1.4 μm |
| Example 6 | I | 0.47 μm |
| Example 7 | J | 1.0 μm |
| Comparative Example 4 | K | 3.2 μm |
| Example 8 | L | 1.4 μm |
| Comparative Example 5 | M | 3.2 μm |

As seen from the results shown in Table 5, when using the electrophotographic photoconductors of the present invention, the decrease ratio of potential at the unexposed area after taking 100,000 copies is less than 5% and the reduction ratio of the sensitive layer thickness after taking 100,000 copies is less than 20%. As seen from Table 5, with reference to Example 3 and Comparative Example 3, the film abrasion loss of the photoconductor of the present invention after taking 100,000 copies showed a decrease of 23% compared with that of the photoconductor of the Comparative Example 3. The film abrasion loss of the photoconductors of Examples 4–7 after taking 100,000 copies showed each decrease of 3%, 56%, 68% and 85% compared with that of the photoconductor of Comparative Example 4, and the film abrasion loss of the photoconductor of Example 8 after taking 100,000 copies showed a decrease of 56% compared with that of the photoconductor of Comparative Example 5. These results are indicative of very excellent abrasion resistance of the photoconductors according to the present invention.

What is claimed is:

1. An electrophotographic photoconductor comprising:

a conductive substrate;

a charge-generation layer formed on said conductive substrate; and a charge-transport layer formed on said charge-generation layer, said charge-transport layer comprising a charge-transport material and a binder resin which comprises a polycarbonate composed of at least one structural unit represented by the following formula I:

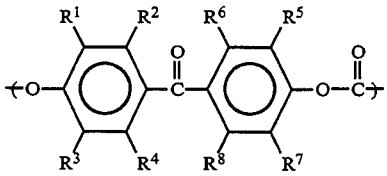

(I)

wherein $R^1$, $R^2$, $R^3$, $R^4$, $R^5$, $R^6$, $R^7$ and $R^8$ each represent independently a hydrogen atom, a saturated or unsaturated aliphatic hydrocarbon group having 1 to 6 carbon atoms, a halogen atom or a phenyl group, wherein the structural units represented by formula I constitute from 3 to 80 mol % of the total structural units of the polycarbonate; and at least one structural unit represented by the following formula II:

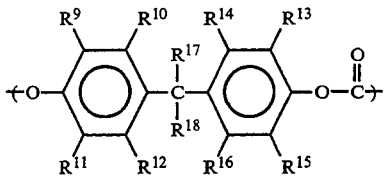

(II)

wherein $R^9$, $R^{10}$, $R^{11}$, $R^{12}$, $R^{13}$, $R^{14}$, $R^{15}$ and $R^{16}$ each represent independently a hydrogen atom, a saturated or unsaturated aliphatic hydrocarbon group having 1 to 6 carbon atoms, a halogen atom or a phenyl group, and $R^{17}$ and $R^{18}$ each represent independently a hydrogen atom, an alkyl group having 1 to 6 carbon atoms or a phenyl group, or $R^{17}$ and $R^{18}$ are combined to form a saturated or unsaturated aliphatic hydrocarbon ring or an aliphatic hydrocarbon ring having an aromatic ring.

2. An electrophotographic photoconductor according to claim 1, wherein a content of the structural units represented by the formula I in the total structural units of the polycarbonate is 5 to 50 mol %.

3. An electrophotographic photoconductor according to claim 1, wherein $R^{17}$ and $R^{18}$ each represents independently a hydrogen atom, a methyl group or an ethyl group.

4. An electrophtograpahic photoconductor according to claim 1, wherein $R^1$, $R^2$, $R^3$, $R^4$, $R^5$, $R^6$, $R^7$ and $R^8$ each represents independently a hydrogen atom, a methyl group or a halogen atom.

5. An electrophotographaic photoconductor according to claim 1, wherein $R^9$, $R^{10}$, $R^{11}$, $R^{12}$, $R^{13}$, $R^{14}$, $R^{15}$ and $R^{16}$ each represents independently a hydrogen atom, a methyl group or a halogen atom.

6. An electrophotographic photoconductor according to claim 1, wherein a viscosity-average molecular weight of said polycarbonate is 10,000 to 500,000.

7. An electrophotographaic photoconductor according to claim 1, wherein the content of said polycarbonate in the binder resin in the charge-transport layer is not less than 50% by weight.

8. An electrophotographaic photoconductor according to claim 1, wherein an amount of said charge-transport material is 20–150 parts by weight based on 100 parts by weight of the binder resin in the charge-transport layer.

9. An electrophotographic photoconductor according to claim 1, wherein a thickness of said charge-transport layer is 5 to 50 μm.

10. An electrophotographic photoconductor according to claim 1, wherein a thickness of said charge-generation layer is 0.1 to 1 μm.

* * * * *